US006437510B1

(12) United States Patent
Thomas et al.

(10) Patent No.: US 6,437,510 B1
(45) Date of Patent: Aug. 20, 2002

(54) CROSSED-FIELD AMPLIFIER WITH MULTIPACTOR SUPPRESSION

(75) Inventors: Gary E. Thomas; James D. Deveau, both of Wenham, MA (US)

(73) Assignee: Communications & Power Industries, Inc., Beverly, MA (US)

( * ) Notice: Subject to any disclaimer, the term of this patent is extended or adjusted under 35 U.S.C. 154(b) by 0 days.

(21) Appl. No.: 09/455,886

(22) Filed: Dec. 6, 1999

Related U.S. Application Data

(60) Provisional application No. 60/111,182, filed on Dec. 7, 1998.

(51) Int. Cl.[7] ..... H01J 25/42; H01P 1/08
(52) U.S. Cl. ..... 315/39.3; 333/252; 333/99 MP
(58) Field of Search ..... 315/39.3; 333/252, 333/99 MP

(56) References Cited

U.S. PATENT DOCUMENTS 2,939,037 A * 5/1960 Jepsen ..... 333/99 MP
3,069,594 A * 12/1962 Feinstein ..... 315/39.3
3,330,707 A * 7/1967 Reed
4,719,436 A * 1/1988 Garwin et al. ..... 333/99 MP

* cited by examiner

*Primary Examiner*—Benny T. Lee
(74) *Attorney, Agent, or Firm*—Nutter, McClennen & Fish, LLP

(57) ABSTRACT

A crossed-field device such as a crossed-field amplifier or magnetron has a cathode body portion and an anode which cooperates with a crossed magnetic field to maintain emitted electrons on cycloidal paths and amplify an input signal or develop a microwave or millimeter wave output signal in an interaction space. The device is switched to shut down between working cycles, and delayed and secondary emissions are reduced to allow low noise operation and reduce multipactor for dependable operation at lower magnetic field strengths. Ceramic windows cover the output transformer (and input transformer in an amplifier device), and at least one window is grooved to reduce its secondary electron yield while maintaining its rf aperture. In addition, one or more walls within the device are physically structured or chemically treated or arranged to further address multipactor, allowing operation at reduced magnetic field strengths. A thin layer of molybdenum oxide may be coated on the anode, and/or a source of molybdenum may be provided in the cathode to form or sustain such a layer in operation. Alternatively, or in addition, one or more walls of the output and/or input transformer may be grooved. For an S-band device, grooves ten mils wide and deep on a ten mil spacing have been formed in the ceramic windows.

11 Claims, 5 Drawing Sheets

CROSSED-FIELD AMPLIFIER WITH MULTIPACTOR SUPPRESSION

CROSS REFERENCE TO RELATED APPLICATION

This application is related to provisional patent application Ser. No. 60/111,182 filed on Dec. 7, 1998. The benefit of that provisional filing is hereby claimed.

STATEMENT REGARDING FEDERALLY SPONSORED RESEARCH

Portions of the present invention were made with support under contracts N00014-92-C-2026 and N00164-90-C-0121 from the United States Navy.

BACKGROUND OF THE INVENTION

The present invention relates to pulsed or intermittently operated crossed-field devices such as crossed field amplifiers (CFAs). By way of example, U.S. Pat. No. 3,255,422 shows one such CFA device wherein a microwave entry waveguide provides radio frequency energy to an entry port for a slow wave propagating structure on an anode. A cathode is opposed to this anode across a gap. A solenoid provides a strong magnetic field perpendicular to the applied electric field. The cathode is formed of a material having a secondary emission ratio greater than unity so that electrons emitted from the cathode due to the electric field follow re-entrant trajectories in the magnetic field and bombard the cathode to cause further electron emission. Energy exchange between the emitted electrons and the rf field results in amplification of the input signal, which is then coupled through an outlet port as an amplified signal into a waveguide.

In some applications, a CFA is designed to operate with the anode and cathode always energized, and a pulsed input signal is applied to the inlet port and amplified as it travels to the outlet. In that case, because the cathode is formed of a material selected to readily emit secondary electrons, such devices, if not provided with a means for shutting down the electron emission, may continue to run spontaneously even when the input signal is removed. Thus, for those devices, it is customary to provide a control electrode as set forth in the aforesaid U.S. Pat. No. 3,255,422 which during a turn-off phase is pulsed near anode potential to capture electrons and thus end the secondary electron re-emission. Other methods of assuring shut-down for these pulsed-input devices may utilize specialized constructions, such as the second anode structure described in commonly-owned U.S. patent application Ser. No. 09/259,643. Other applications of CFAs operate by switching the anode/cathode potential on and off. These latter CFAs operate without such a control electrode structure, but are subject to multipactor effects from the high voltage switching cycles.

In general, when these devices are operated for example as high-power radar tubes, they are operated with extremely high powers but low duty cycles, thus requiring them to be switched on and off at high speeds. The nature of the crossed-field amplifier, requiring large secondary electron emissions, makes it particularly susceptible to multipactor and other gas discharge effects during such switching, and the multipactor effects are particularly pronounced with lower magnetic fields.

Some potential advantages of using a low magnetic field have been recognized since the early days of magnetron and crossed-field amplifier development. However, in general, for high power amplifier as described above, it has been necessary to employ relatively high magnetic fields in order to avoid multipactor and sustain clean operation and switching. The field strength is typically several thousand Gauss in the interaction region of an S-band device operating at 150 to 300 kilowatts peak power, and somewhat lower at the surfaces and lead-in portions of the amplifier outside the interaction space where many multipactor effects are sustained. The ability to operate a high powered microwave or millimeter wave device with a lower magnetic field would offer advantages in terms of physical weight as well as operation and signal quality.

The presence of multipactor and gas discharge effects on the anode circuit and elsewhere within the device has been recognized as a significant problem arising with a low magnetic field. One existing theory suggests an approach to overcome this problem by simply employing a magnetic field which exceeds the cyclotron value to suppress discharges perpendicular to the magnetic field (i.e., between anode vanes). However, applicant's initial attempt to implement such a solution with a magnetic field operating at a strength slightly above the cyclotron value showed that while discharges between vanes exist mainly below the cyclotron resonance field, they extend above this value to an extent which can interfere with the performance of the cross-field amplifier. The physics of this process is complex. Ordinarily, secondary emission occurs on a time scale orders of magnitude less than an rf cycle. The cyclotron resonance multipactor cut-off depends on this property. Both analysis and experiment suggest that the discharges above the cyclotron resonance field result from an ability of oxidized surfaces with insulating properties to store charge generated by incident primary electrons for an appreciable fraction of an rf cycle, and to subsequently emit this charge when the rf field reverses. The emission is a form of thin-film field emission, but its result is the same as, or may be modeled as, a secondary emission with time delay having a duration which is significant relative to the duration of an rf cycle. Reference to this effect in the literature employs the term "time-delayed secondary emission". Unfortunately, oxides are necessary components to achieve the high yield of secondary electrons upon which the traveling wave amplification effects depend, and the harsh conditions within the interaction space operate to transport these, or produce other, oxides. Given the presence of such oxides, it would appear that, at present, only very high magnetic fields can effectively eliminate multipactor.

Accordingly, it would be desirable to provide such a device that operates dependably without multipactor at lower magnetic field strengths.

SUMMARY OF THE INVENTION

The present invention overcomes deficiencies of known devices by providing a crossed-field device such as a crossed-field amplifier or magnetron wherein a distributed cathode body is spaced from an anode to provide an electric field in a slow wave region or interaction space, which, in a crossed-field device, extends for example between a signal inlet and an outlet, and the slow wave region is arranged to have a magnetic field oriented perpendicular to the electric field to enhance generation of secondary electrons. At least one window, and in an amplifier preferably both of the output and input windows to the amplifier tube, are formed with a closely spaced set of grooves over the window surface, and at least one other major surface component of the assembly is grooved, coated or is otherwise configured to further inhibit secondary electron emission or delayed emission. In a preferred embodiment the windows are formed of ceramic or material transparent to radiation, and have a regular array of parallel grooves approximately ten mils wide and ten mils deep on a ten mil spacing. The amplifier may possess a cathode of secondary emitting material, such as beryllium, and secondary emission may be inhibited on the anode surface by providing a molybdenum oxide coating. Alternatively, or in addition, the cathode may have molybdenum wires, strips or segments included in a portion of its surface area to provide a reservoir or source of material that supplies the anode with sputtered or vaporized molybdenum during operation to maintain its operating characteristics. The grooved window may also be employed in conjunction with grooving of some or all of the major surfaces of the input and/or output transformers.

BRIEF DESCRIPTION OF THE DRAWINGS

These and other features of the invention will be understood from the description below taken together with the drawings wherein.

DETAILED DESCRIPTION OF THE INVENTION

Figure 1:
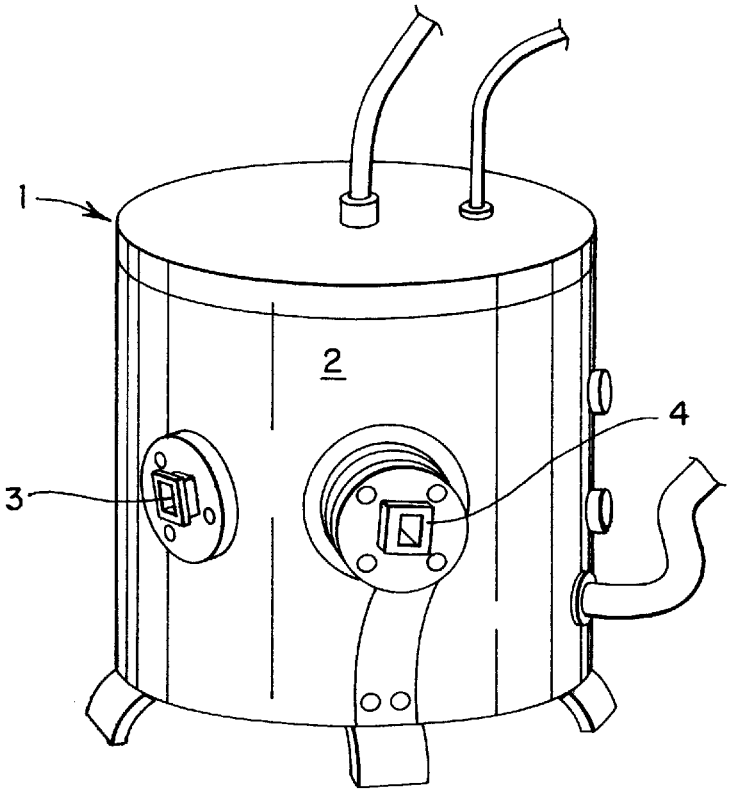
FIG. 1 (PRIOR ART)
FIGS. 1, 1A and 1B illustrate crossed field amplifier (CFA) devices of the prior art.

FIG. 1 illustrates an external perspective view of a representative crossed-field amplifier device 1 of the prior art. As shown, the crossed-field amplifier device includes an inlet port 3 for providing input microwave energy into a body 2, where it is amplified by the crossed-field interaction as it travels to an outlet 4 which carries the amplified energy away. A crossed-field amplifier (CFA) tube can be described as part magnetron and part traveling wave tube. Like a magnetron it utilizes crossed electric and magnetic fields to produce rf energy from emitted electrons. Like a traveling wave tube (TWT) the electrons interact with a traveling wave, and the device is an amplifier. Power is generated with high efficiency for the same reasons that a magnetron operates efficiently; power is also generated at voltage levels similar to those of a magnetron, i.e., many kilovolts. As shown in FIG. 1, a CFA may look quite like a magnetron, with the same form factor but with the addition of an input port.

Figure 1A:
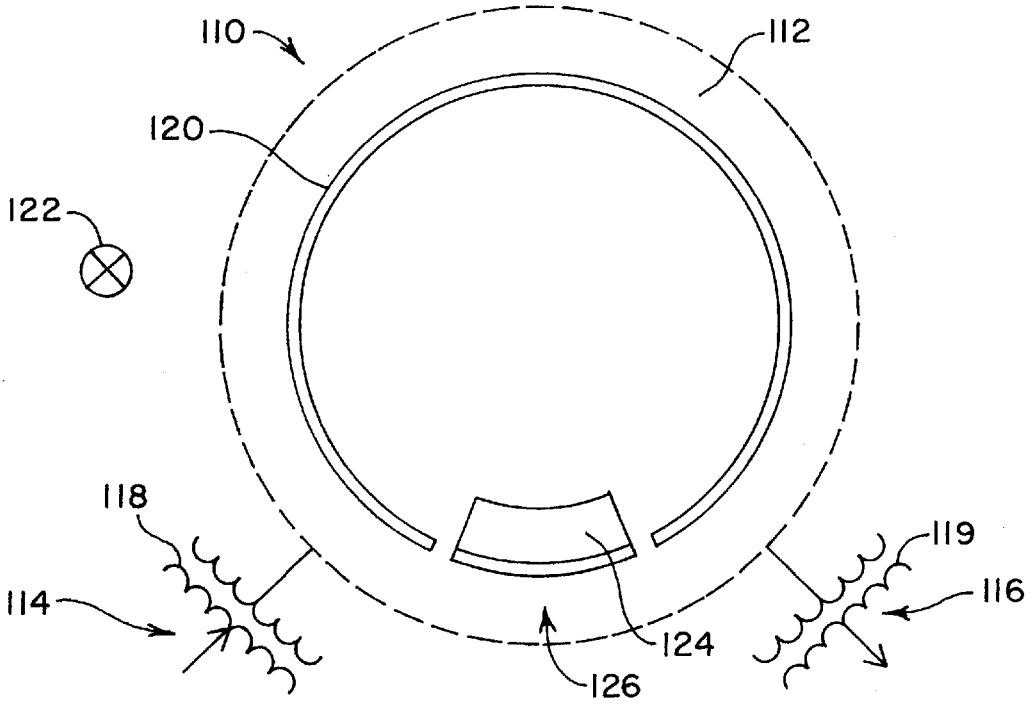

FIG. 1A schematically represents the elements and operation of one CFA 110. The CFA device 110 includes a slow wave circuit 112, an input/output system 114, 116, respectively, and an electron system. The slow wave circuit 112, or delay line as it sometimes called, is a periodic structure which has the circuit characteristics of a bandpass filter. This may be implemented by a regular set of radially oriented vanes, that extend inwardly, for example, from a surrounding circumferential anode structure. The slow wave circuit 112 propagates rf energy over the frequency range of interest while providing fringing electric field lines with which electrons may interact. These fields must have a phase velocity approximately equal to the velocity of the electron stream.

The input/output system 114, 116 provides an impedance transformation between the rf transmission line system external to the amplifier, and the slow wave circuit 112 itself. For microwave signals, this may involve a tapered chamber, which extends from the vacuum sealing ceramic window at the external wave guide to a narrow slot-like entry port or passage at the interaction space. These impedance transformations or circuit matches 118, 119 (for input and output, respectively) may determine the useful bandwidth of the CFA itself.

The electron system generates electrons, and confines them to the interaction area i.e., to the slow wave circuit 1 12, where they give up energy to the rf field and thus "amplify" the input energy. The electron system also collects electrons when they are spent. Some CFAs have a relatively large cathode 120 which extends the entire length of the slow wave circuit 112. In these CFAs, electrons are generated along the entire length of the cathode 120, giving rise to the name "distributed emission amplifier". The cathode 120 is also called the sole, from which the name "emitting sole amplifier" has arisen.

The distributed emission amplifier can be arranged in a number of ways. It can be made in either a linear or a circular architecture. Amplifiers made with the circular format may collect electrons at one end of the circuit, or the input and output sections may be brought close enough together so that the electrons from the output are permitted to continue along and re-enter the interaction area at the input.

Re-entrance is employed in many amplifiers to enhance efficiency. When reentrance is employed, however, it is possible that re-entering electrons may be modulated with information that will subsequently be amplified. This is equivalent to providing an rf feedback, and this feedback must be considered in determining the behavior of the amplifier. It is also possible to obtain re-entrance after demodulating the electron stream to eliminate such rf feedback.

CFAs are mostly used for high-power applications, as opposed to small signal use, and the slow wave circuit must be capable of dissipating the collected beam and transferring that energy to a heat sink. A typical use, for example, is as a broad band phase stable microwave amplifier for a coherent radar chain, to efficiently generate very high peak output power from a relatively low input voltage which can be either applied to the cathode or to an electrode similar to a TWT cathode, or may operate by grid pulsing. Such CFAs may be produced in small lightweight packages. The invention will be described below with respect to an essentially cylindrical arrangement of opposed cathode and anode elements in which the traveling wave or interaction region occupies a major portion of the circumference, between the inlet port and the outlet port. However, the construction of the invention may also be implemented in other distributed emission devices, such as magnetrons. In the prior art device of FIG. 1A, a control electrode segment 124 separate from the cathode 120 may be pulsed to shut down amplifier operation in synchrony with the trailing edge of a pulsed input signal, while the cathode and anode potentials remain unchanged. In the prior art device of FIG. 1B, which is essentially the same device in FIG. 1A except no control electrode is provided, and the cathode/anode potential is changed to interrupt the output signal. This high voltage switching is vulnerable to multipactor effects that increase the noise level of the output.

Figure 2:
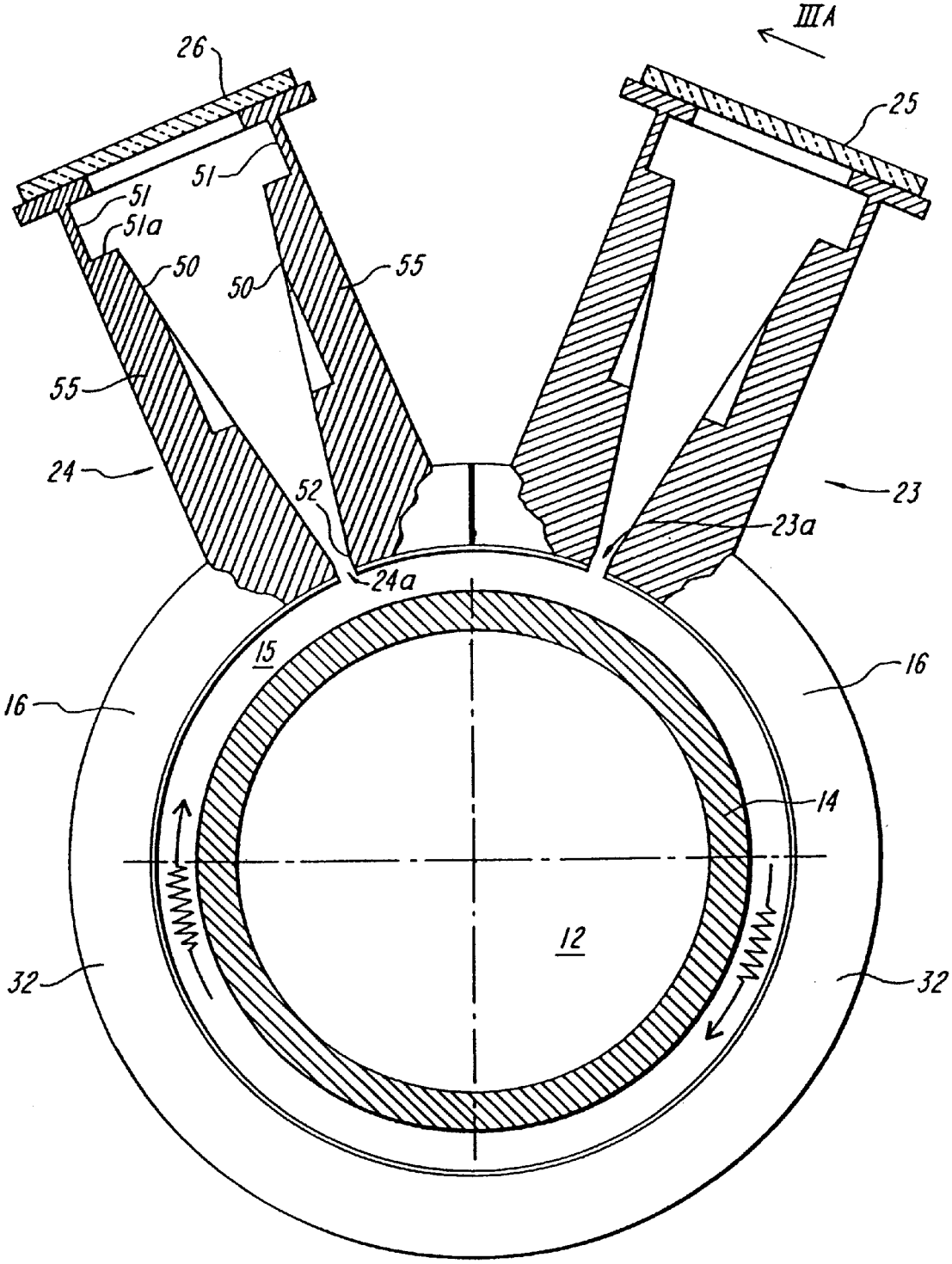
FIG. 2 is a cross-sectional view, partly schematic, of one embodiment of a device of the present invention.

FIG. 2 shows an illustrative embodiment of the present invention as a crossed-field amplifier 10 of generally cylindrical shape, in a view showing the electrode layout, with the anode 16 indicated schematically, without specifically illustrating the radially-oriented vanes of the slow wave circuit 32. The input and output matching transformers 23, 24 are shown, having ramped profiles 50 to efficiently match the external waveguides to the respective narrow slots 23*a*, 24*a* where energy is coupled into and out of the interaction region or traveling wave space, peripheral gap 15. CFA 10 has a generally cylindrical cathode 14.

The outer end of each of the inlet and outlet transformers is covered by a ceramic window 25, 26 which is essentially transparent to the rf energy of interest and is sealed by brazing to the end to maintain vacuum inside the amplifier tube.

It will be appreciated that the actual construction of a crossed field amplifier tube may employ somewhat varied overall architectures, and dimensions will vary depending upon the wavelengths to be amplified as well as the intended power and operating cycles. In general the present invention contemplates microwave or millimeter wave signals, having frequency between 450 MHz and about 35 Ghz, and operating at high power levels during switched time intervals, with an overall duty cycle under about 5%.

As shown in FIG. 2 a central support 12 carries a cylindrical cathode 14 which is spaced across a gap 15 from the inner diameter wall of the anode structure 16. The cathode is preferably made of a cold secondary emission type material such as beryllium or platinum. For a typical L-band amplifier, the device may, have an outer diameter of approximate ten centimeters, with a cathode outer diameter (OD) of about seven centimeters and a height of approximately four centimeters. The structure of a corresponding S-band or shorter wavelength device may differ, and have generally smaller dimensions although generally requiring higher magnetic field strengths, for example in the range of 2500 Gauss. Typically the cathode is carried by a ceramic support structure, with supporting conductors of copper or other suitable metal. Copper may also be used for the input and the output transformers 23, 24.

For one typical device the outer structure, anode 16 is maintained at ground potential, while the cathode is set negative, so that electrons are drawn from the surface of he cathode into the gap 15. The entire assembly is maintained in a permanent magnet package or solenoid (not shown) which provides the strong magnetic field in the gap 15 with lines perpendicular to the electric field.

Electrons emitted from the cathode 14 are accelerated radially outward because of the voltage potential between the cathode 14 and the anode 16. If there is no rf drive power, the perpendicular (axial) magnetic field will cause the electrons to cycloid back to the cathode surface since the interaction space 15 is normally operated at a voltage below cut-off. However, when rf drive power is present, electrons emitted from the cathode 14 are sorted into two groups. The first group of electrons, known as the favorable phase electrons, give up dc potential energy to the rf wave. These electrons are collected at the anode 16. The second group of electrons, the unfavorable phase electrons, absorb some energy from the rf wave on the anode circuit. With this additional energy, these electrons are driven back into the surface of cathode 14 with several hundred electron volts of energy. As a result of this electron bombardment, the cathode 14 emits new electrons with a yield δ by secondary emission. δ is typically sufficiently greater than one, so a dense region of electrons is maintained near the surface of the cathode 14; this dense region of electrons is usually referred to as the hub. Typically, the material of the cathode 14 has a secondary yield greater than two so that maintaining the hub is not a problem. The amount of dc energy given to the rf wave on the anode circuit by the favorable phase electrons more than offsets the amount of energy absorbed by unfavorable phase electrons, and hence there is a net rf amplification of the rf circuit wave on the anode 16.

Thus, in overall operation, the device amplifies the input rf drive power, so the outlet 24 receives a greatly increased rf power.

As shown in FIG. 1A, in other constructions a control electrode may occupy a partial circumference of the cylinder, for example, located in the region of the inlet and outlet rf ports, and away from the traveling wave interaction area which makes up the major portion of the circumference of the device. However, the present invention is intended primarily for applications wherein the cathode/anode voltage is itself switched, and it addresses the multipactor effects of such switching operation.

As described above, a high powered device may operate with relatively fast switching and a low, e.g., 1%–5% , duty cycle, but is vulnerable to multipactor effects which increase the noise level and are more severe with lower magnetic field strengths. The surface oxide films causing the multipactor discharge build up gradually during the lifetime of the crossed-field device. This build Lip is due to oxidation of exposed copper and/or to sputtered deposition of beryllium oxide or other secondary electron emitting material from the cathode. The oxidation and sputtering mechanisms are present due to the oxygen needed to maintain cathode emission or the oxides employed on the cathode for their high δ. While the resulting discharge may be weak and introduce only a small amount of attenuation of the RF signal, fluctuation of the discharge is a significant source of noise close to the carrier. This fluctuating discharge limits the noise performance of the crossed-field device.

In accordance with a principal aspect of the present invention, applicant has found that the irregular firing or multipactor effects may be substantially reduced and allow operation with lower noise, or at magnetic field strengths approximately one half of those currently employed, by employing a grooved ceramic window in the rf signal path in combination with one or more other modifications of a surface region in the interior of the tube to reduce emissions. Preferably both the input and output windows are grooved, and the grooves form a regular array extending across the central region of the window.

Figure 3A:
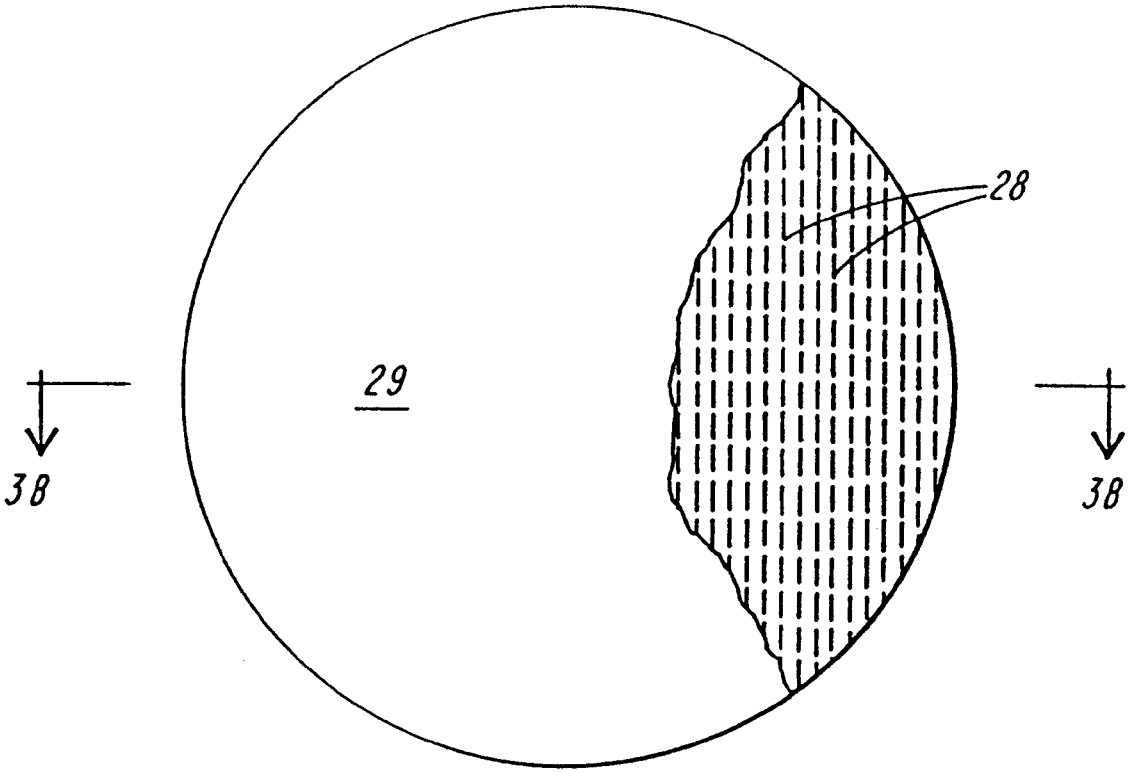
FIGS. 3A and 3B show windows of the embodiment of FIG. 2.
Figure 3B:
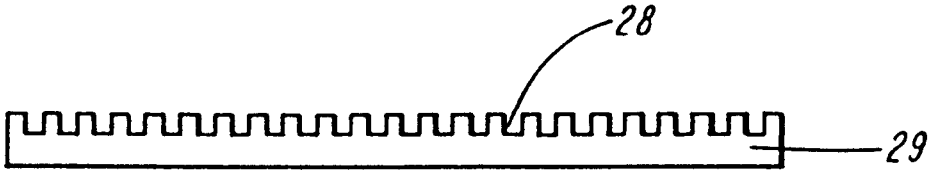

FIGS. 3A and 3B illustrate one suitable embodiment of such a window 29 which may for example function as the input window 25 or/and the output window 26 of the device of FIG. 2. As shown, window 29 has grooves 28 which extend in parallel across the face of the window. Preferably the array extends entirely across the face and thus covers the entire area, although for convenience of illustration only some of the grooves are shown in FIG. 3A. FIG. 3B illustrates a section taken transverse to the plane of the window 29 as used in an S-band crossed-field amplifier embodiment. As shown, the grooves extend close to each other and have width, depth and spacing dimensions which are all comparable. In the exemplary embodiment for a window employed on an S-band device, the groove spacing, width, and depth were each 10 mils. The grooves were formed by machining with a thin diamond saw blade to form closely-spaced, parallel, straight-walled trenches, and the machined window was then cleaned, metallized and brazed to its mounting structure. In use, the grooved side of the window faces inwardly, toward the interior of the amplifier tube 10. The window itself was formed of beryllia or other ceramic, and was a disk about 3.5 inches in diameter and an eighth of an inch thick.

In addition to having one or more grooved windows, the crossed-field amplifier of the present invention includes one or more interior surfaces of the amplifier assembly and or transformers having a physical structure or surface material modified to reduce or suppress multipactor, or its trigger events.

In one embodiment, the anode is sputter coated with a molybdenum oxide layer to inhibit such discharge. The coating may be effected by sputtering molybdenum in an oxidizing atmosphere, and the oxide deposition is carried out to deposit a thin sputtered layer, with thickness much less than the rf skin depth and which thus does not affect the attenuation of the circuit. Applicant has found that the effectiveness of this molybdenum oxide coating may diminish over time due to sputtering of the beryllium oxide or other secondary electron emitting material from the cathode. This may occur over the course of a relatively short period of amplifier operation, on the order of tens of hours.

Figure 5:
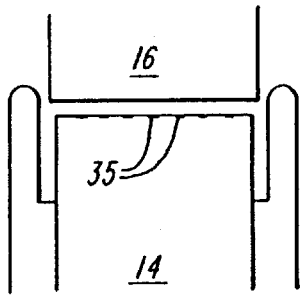
FIG. 5 illustrates cathode construction of another embodiment.

This aging of the anode 16 coating is addressed in a further embodiment of the invention by embedding molybdenum wire, disk, or strip areas 35 in the surface of the cathode 14 as shown in the cross-sectional view of FIG. 5. The exposed molybdenum areas 35 cover only a minor area of the cathode, leaving the basic electron-generating mechanism unimpaired, but the area 35 is made large enough so that molybdenum is sputtered from those exposed areas to poison, coat or otherwise suppress the emission properties of the sputtered secondary-emitting material accreting on the anode, and to preserve the discharge suppression properties of the original molybdenum oxide anode coating. Using this molybdenum suppressor-regeneration construction in a prototype embodiment tested for over 3,000 hours at 1% duty cycle, the test noise level degraded only slightly at the lower end of the intended frequency band. Because oxygen pressure drops substantially over the first thousand hours of operation, and the rates of surface oxidation and oxide sputtering drop to very low levels, the effectiveness of exposed molybdenum to maintain the anode coating beyond the initial hours of operation of the CFA indicates a deposition rate that can be expected to remain effective over a much more extended period of operation. Thus, the molybdenum oxide coating on the anode is preserved and effective throughout the life of the tube.

In addition to such coating, applicant contemplates embodiments of the grooved window construction wherein major wall portions or metallic or oxidized surfaces of major components within the active signal path in the amplifier are grooved to further reduce secondary emissions. In particular, major surfaces in the input or output transformers 23, 24 are preferably provided with grooving, which may be similar to the grooves applied in some other microwave tubes to reduce secondary yield.

Figure 4A:
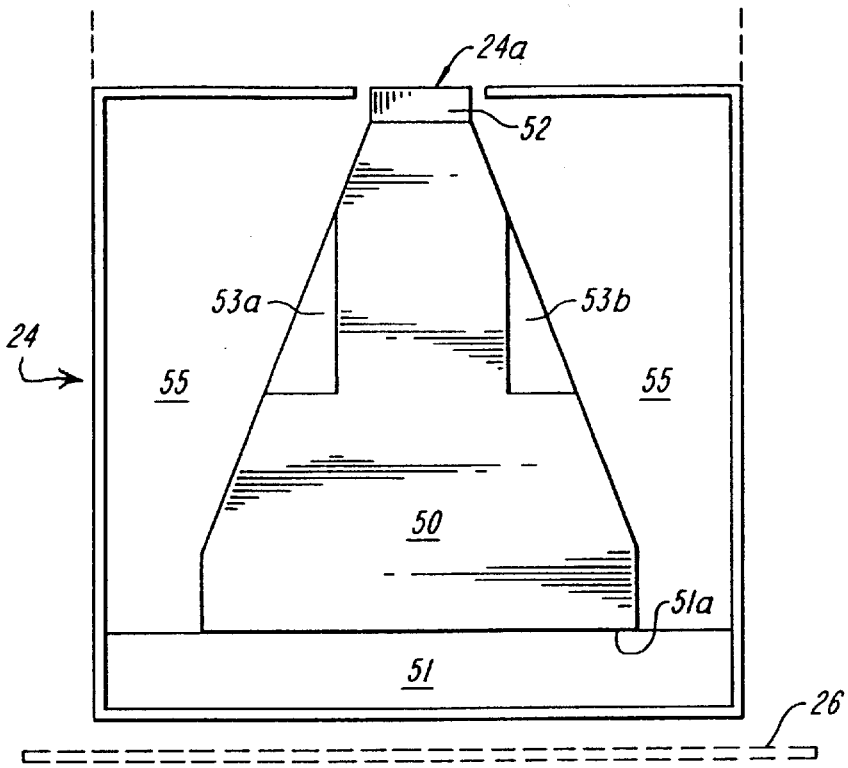
FIGS. 4A and 4B illustrate the input/output transformers of another embodiment.
Figure 4B:
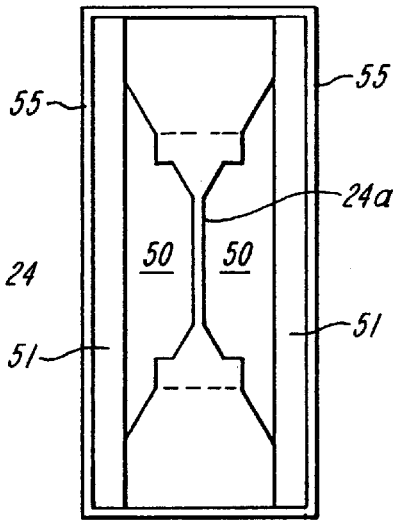

FIGS. 4A and 4B further illustrate the geometric structure of one suitable transformer which, for purposes of illustration will be taken to be the output transformer 24 of FIG. 2, and in FIGS. 4A and 4B, like reference numbers refer to like elements of FIG. 2.

Figure 1B:
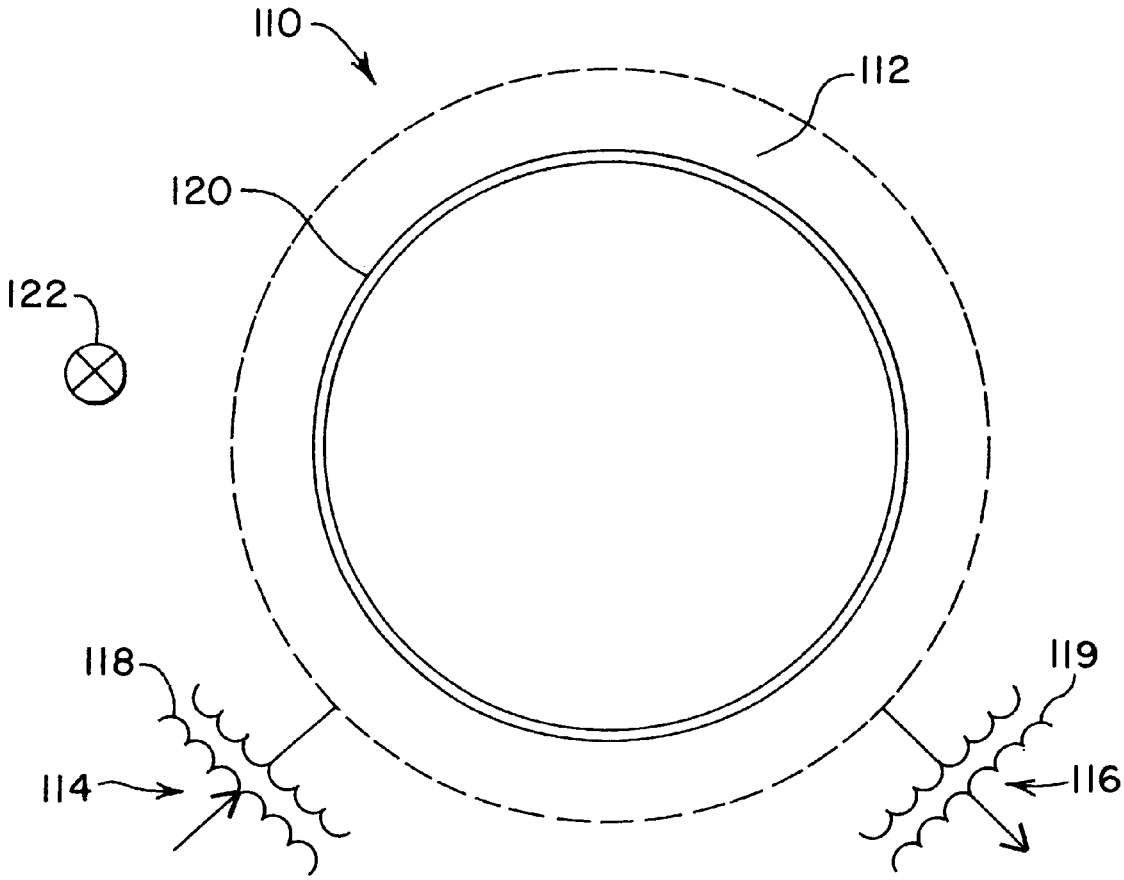

Before further describing exemplary output transformer 24 (by reference to FIGS. 2, 4A and 4B, reference is first made to FIGS. 1A and 1B, in which a cylindrical cathode or sole 120 defines one side of a radially-oriented electric field gap, in which a crossed (axially oriented) magnetic field 122 is present, as indicated by a circled cross symbol. A portion of the circumference defines a slow wave circuit 112 in which an rf signal is amplified by interactions with electrons in the crossed field. An input signal enters the device through an impedance input match or transformer section 114, and the amplified signal exits through an output match or transformer section 116. As shown in FIG. 1A, a drift region 126 and control electrode 124 may be provided between the output and input regions to control re-entrance. The impedance matching input and output transformers 114, 116 may be implemented in a known fashion with various shaped or tapered channels adapting an external waveguide to the interaction cavity of the crossed field amplifier (CFA) device 10 and the gap between the cathode 14 and anode 16 (FIG. 5).

As shown in FIGS. 2, 4A and 4B, transformer 24 extends from the output rf iris, slot 24a of the amplifier tube 10, and includes an elongated ramp 50. FIG. 4A shows a plan view parallel to the center line of the device 10 in a plane extending through the rf aperture and perpendicular to the plane of the drawing in FIG. 2 (i.e., a side view, for example, in the direction of arrow 24 in FIG. 2). The window 26 is indicated schematically and the rf iris or slot is indicated generally as 24*a*. The transformer 24 body 55 itself may be composed of two identical shell portions symmetric about the center line to form a generally rectangular signal conduit having internally-protruding walls to shape and guide the desired single-mode signal between the amplifier and an external waveguide, which is generally multi-node.

As shown, the transformer body includes a major ramp surface 50 (two shown) running between the large window 26 and the rf iris 24*a* of the crossed-field device. Ramp 50 runs from a broad end at an initial step 51 formed within transformer body 55 (and in particular from edge 51 a of step 51) centrally aligned with the position of the external waveguide, and extends inward within the transformer body 55 on each side as a sloping wall decreasing in width as it slopes inward of the center plane of the assembly to a flat face 52 close to the center plane at the rf iris 24*a* of the amplifier. In the illustrated embodiment of FIG. 4A milled flats 53*a*, 53*a* on the wings of the ramp further define and tailor the transformer impedance or transfer characteristics. The geometry of the transformer will be further visualized from FIG. 4B, which shows a plan view of the two assembled halves of the transformer aligned parallel to the major axis of the rf aperture and the waveguide, as viewed from the window 26 looking inward toward the amplifier tube 10. Beyond the specifically numbered or identified surfaces of the ramps or steps forming the features of the transformer assembly, various other unlabeled bounding walls also define the peripheral space along the signal path, and these shall be referred to generally herein simply as transformer body or housing walls.

In accordance with this further aspect of the invention, grooves are provided in the metal surface of one or more of these major signal guiding walls in the input and/or output transformer. Thus, surface 50, surface 52, surfaces 53*a* and 53*a*, as well as the vertical surfaces bounding the major portion of ramp 50 and the interior body or housing walls of the transformer may each be provided with grooves. The grooving may run parallel to the direction of signal propagation or transversely, and is generally dimensioned so as to not introduce unwanted resonance or interference effects in the underlying signals, but to effectively trap secondary electrons and/or decrease the area from which secondary electrons may be emitted along trajectories that enter the signal path. To the extent grooves have been employed for emission reduction in microwave constructions in the past, such grooves may be generally suitable for transformer surfaces of the present invention. It will be understood that the input and output transformers reside generally in a peripheral region about the amplifier, in which the magnetic field is a fringing field of lesser strength than in the interaction region 15 between the cathode and anode of the amplifier tube itself. It may in some circumstances be desirable to set the spacing or dimensions of the grooves or their orientation so as to more effectively assure that secondary emissions occurring along the treated region are trapped within the grooves or do not affect tube operation or contribute noise to the output signal. In general, the grooving may take various dimensions and orientations, and be positioned in such locations as may be effective to reduce the secondary electron yield of the surface and lower the noise level or operate stably with reduced magnetic fields in practice.

Thus the invention contemplates operation with a grooved window and chemical treatment or physical structure embodied in the walls of at least one major operating portion of the device or its transformers. The combination of two or more of the wall stabilizing or suppressing features is especially preferred for enhanced noise reduction and extended operation with lower noise and/or at lower magnetic field strengths, which may for example be dependably reduced by as much as one half.

The invention being thus disclosed and representative embodiments thereof described, further variations and modifications will occur to those skilled in the art, and all such variations and modifications are considered to be within the spirit and scope of the invention, as set forth in the claims appended hereto and equivalents thereof.

What is claimed is:

1. A crossed-field device such as a crossed-field amplifier, such device including:

an inlet for accepting an input signal to said device for amplification, said inlet having an inlet window;

an outlet for carrying an amplified signal from said device; said outlet having an outlet window;

a cathode body portion having an emitter surface configured for secondary emission of electrons; and an anode portion spaced about said cathode body portion providing a gap between said cathode body portion and said anode portion, said cathode body portion and said anode portion providing an electric field in said gap along an interaction slow wave traveling region wherein a crossed magnetic field in said slow wave traveling region cooperates to maintain emitted electrons on cycloidal pathways as they travel between said inlet and said outlet;

wherein at least one of said inlet window and said outlet window is a grooved window; and wherein said crossed-field device operates with a low duty cycle in a switched mode and said crossed-field device further comprises a surface region internally disposed between said inlet and said outlet having a surface material structure that reduces secondary electron emission and operating in conjunction with said grooved window so as to suppress multipactor during switched operation of said crossed-field device, said surface region having a surface material structure that reduces secondary electron emission comprising exposed molybdenum wires, strips or segments provided on a surface of said cathode body portion.

2. The crossed-field amplifier of claim 1, wherein said inlet and said outlet each include at least one signal guiding wall and at least one signal guiding wall includes a grooved surface.

3. The crossed-field amplifier of claim 2, wherein said anode portion includes a molybdenum oxide coating.

4. The crossed-field amplifier of claim 1, wherein the anode portion includes a molybdenum oxide coating for multipactor suppression.

5. The crossed-field amplifier of claim 1, wherein said at least one grooved window includes a regular array of parallel grooves extending across an rf aperture of said window, said grooves having a spacing, a width and a depth to suppress multipactor.

6. The crossed-field amplifier of claim 5, wherein said grooves are approximately one-quarter millimeter wide and approximately one-quarter millimeter deep.

7. A crossed-field device such as a crossed-field amplifier, such device including:

an inlet for accepting an input signal to said device for amplification, said inlet having an inlet window;

an outlet for carrying an amplified signal from said device; said outlet having an outlet window;

a cathode body portion having an emitter surface configured for secondary emission of electrons; and an anode portion spaced about said cathode body portion providing a gap between said cathode body portion and said anode portion, said cathode body portion and said anode portion providing an electric field in said gap along an interaction slow wave traveling region wherein a crossed magnetic field in said slow wave traveling region cooperates to maintain emitted electrons on cycloidal pathways as they travel between said inlet and said outlet;

wherein at least one of said inlet window and said outlet window is a grooved window; and wherein said crossed-field device operates with a low duty cycle in a switched mode and said crossed-field device further comprises a surface region internally disposed between said inlet and said outlet having a surface material structure that reduces secondary electron emission and operating in conjunction with said grooved window so as to suppress multipactor during switched operation of said crossed-field device, said surface region having a surface material structure that reduces secondary electron emission comprising a molybdenum oxide coating provided on said anode portion.

8. The device of claim 7, wherein exposed molybdenum wires, strips or segments are provided on a surface of said cathode body portion.

9. The device of claim 7, wherein said inlet and said outlet each include at least one signal guiding wall and at least one signal guiding wall includes a grooved surface.

10. The device of claim 7, wherein said at least one grooved window includes a regular array of parallel grooves extending across an rf aperture of said window, said grooves having a spacing, a width and a depth to suppress multipactor.

11. The device of claim 16, wherein said grooves are approximately one-quarter millimeter wide and approximately one-quarter millimeter deep.

* * * * *